US006820354B1

(12) United States Patent
Zanatta et al.

(10) Patent No.: US 6,820,354 B1
(45) Date of Patent: Nov. 23, 2004

(54) SPORT SHOE PROVIDED WITH A DEVICE TO CONTROL THE FLEXION OF THE TOE

(75) Inventors: Ivo Zanatta, Montebelluna (IT); Claudio Franco, Montebelluna (IT)

(73) Assignee: Jolly Scarpe S.p.A., Montebelluna (IT)

( * ) Notice: Subject to any disclaimer, the term of this patent is extended or adjusted under 35 U.S.C. 154(b) by 0 days.

(21) Appl. No.: 10/174,565

(22) Filed: Jun. 19, 2002

(51) Int. Cl.[7] ..... A43B 5/04; A43B 13/16

(52) U.S. Cl. ..... 36/117.3; 36/117.4; 36/102; 36/31

(58) Field of Search ..... 36/117.1, 117.3, 36/117.4, 118.2, 118.3, 118.4, 118.7, 118.8, 102, 31

(56) References Cited

U.S. PATENT DOCUMENTS

| | | | | | |
|---|---|---|---|---|---|
| 3,067,531 | A | * | 12/1962 | Scott et al. | 36/117.1 |
| 5,623,773 | A | * | 4/1997 | Bergamin | 36/117.1 |
| 5,664,344 | A | * | 9/1997 | Marmonier | 36/118.2 |
| 5,722,867 | A | | 3/1998 | LaGrow | |
| 5,740,620 | A | * | 4/1998 | Giese et al. | 36/118.2 |
| 5,832,635 | A | * | 11/1998 | Finney et al. | 36/118.8 |
| 6,155,577 | A | * | 12/2000 | Okajima | 36/117.1 |
| 6,263,593 | B1 | * | 7/2001 | Pierce et al. | 36/118.3 |
| RE37,319 | E | * | 8/2001 | Meiselman | 36/117.1 |
| 6,364,323 | B1 | * | 4/2002 | Coulter | 36/118.8 |
| 6,405,457 | B1 | * | 6/2002 | Basso et al. | 36/117.1 |
| 6,406,040 | B1 | * | 6/2002 | Thorne | 36/117.1 |

FOREIGN PATENT DOCUMENTS

| | | |
|---|---|---|
| FR | 2 045 319 | 2/1971 |
| FR | 2 142 886 | 2/1973 |
| GB | 0574265 | 12/1945 |
| WO | 99/47013 | 9/1999 |
| WO | 01/35781 | 5/2001 |
| WO | 02/052969 | 7/2002 |

* cited by examiner

*Primary Examiner*—Anthony Stashick
(74) *Attorney, Agent, or Firm*—Guido Modiano; Albert Josif; Daniel O'Byrne

(57) ABSTRACT

A sporting shoe equipped with a device to control the flexion of the toe includes a localized low friction protection body, particularly for a technical boot designed for practicing the sport of motorcycling, removable, attached along one side of the shoe with the use of reciprocal holder and engaging at least part of the point and of the side. The protection body is hinged to a second element, placed at the back, fixed along the external side of the shoe or a part of it, with the cooperation of a third element ovelapping the first two, which, engaging the second, provides two opposite stops that limit the run of the protection body and of the toe part of the relative shoe, or of a part thereof with respect to the back part.

13 Claims, 2 Drawing Sheets

SPORT SHOE PROVIDED WITH A DEVICE TO CONTROL THE FLEXION OF THE TOE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This invention refers to a device to control the flexion of the toe, particularly in a sporting shoe.

The innovation finds particular even if not exclusive application in the field of technical goods for practicing the sport of motorcycling.

BACKGROUND OF THE INVENTION

Shortly, it is possible to remember that a typical motorcycling boot is made of an upper, mostly of leather and thick, engaging the lower limb, surrounding the foot and also a good part of the calf. Furthermore an outsole is present, also generally thick, made of plastic material, to which the respective upper is joined. On the inside, the shoe provides an underfoot joined to the outsole and in some cases a lining, seamed to the inside of the upper. In some cases, instead of the common lining and localized only in some points, padding material can be provided for, like rubber, or even thermally-formed plastic material, that helps make the shoe more comfortable.

It is also a known fact that the user of such goods is a traditionalist, in the sense that he is usually somewhat mistrusting towards technological innovations, therefore, when choosing the product, he opts for more accurate boot solutions considering what materials have been used, for example preferring those with first quality skins, rather than the presence of technical solutions. These circumstances have in fact prevented a suitable technological progress of the motorcycle boot, placing it in the field of those products less permeated by innovations.

The spirit animating the bike rider is a legend. The racing biker in particular manages to appreciate his own motorcycle only when carrying out evolutions that do not necessarily coincide with the literal meaning of the word, but can seem like such for an onlooker. In the execution of a curve, the motorbike notoriously tends to tilt, originating what in lingo is defined a "fold", and it is precisely this characteristic that leads people to believe that driving is extremely dangerous. As a matter of fact, this movement can be more or less accentuated, and depends both on the position assumed by the biker and on the speed with which he prepares to take the curve. As hazardous as the maneuver can be, it is easy to guess that even the novice, when riding his bike, for example when driving along a mountain road, full of bends, will find himself in the condition where he produces many folds, even consecutive ones and inadvertently, depending only on the configuration of the track. This movement, which we can define as a pendulum, then causes a side acceleration, provoking an uncontrolled fold, which can produce an extra-inclination of the bike strong enough to cause the lower appendixes and the parts closest to the frame to come in contact with the ground.

If these conditions of use are not so frequent for the novice, for the experienced biker they are rather common, not only when riding on mountain roads, but also on routes traditionally considered not very exacting, as for example the execution at moderate speed of a 90° bend. Finally, the fold is certainly the rule in motorbike racing, where engaging at full speed curves and reverse curves causes extremely exciting extra-inclinations of the bike, one can say at the limit of roadholding.

Due to these excessive folds, to the one side and then to the other, inevitably some parts of the motorbike, as for example the control pedals or other appendixes, come in contact with the ground. Some body parts are above all even more exposed to contact with the ground; because of their natural position and of the fact that they may be induced to protrude outside the bulk of the bike, they are engaged by a rubbing that can be prolonged, causing a localized abrasion of the coating material. These parts are notoriously positioned in the toe of the shoe, or along the side, at the height of the last external phalanx, but also at the height of the malleolus and of the articulation of the knee. One can conclude, consequently, that these parts, and others still, conveniently interested by the technical clothing, during the execution of the fold are therefore frequently in contact with the cemented surface that, being rough, at the least locally abrades the external layer.

The described phenomenon, for example, is observable with particular evidence in professional riders who, as is well known and because of wear, beyond any promotional need, replace their footwear with every race. The shoe, in fact, or more precisely the boot, is the part that most comes into contact with the ground because, by resting with the sole on the control pedals placed somewhat behind, it is naturally caused to protrude at least with the toe, underneath the frame, and therefore it usually comes closer to the track than other parts of the body.

In consideration of the problems mentioned above, certain devices, known as slider-protection, have been progressively entering the market, which have the purpose of protecting locally the parts of the footwear subjected to rubbing. These devices are also interchangeable, and substantially consist of at least one rigid plastic body, which on one side is provided with a configuration that adapts along a few centimeters of the external side of the shoe, originating a swell whose extrados presents a rounded surface.

The sole use of the slider protection, however, immediately proved to be insufficient, not so much for the safeguard of the shoe, but for avoiding that, during the race, the shoe and therefore the foot stressed by the contact with the ground, is forced to make unnatural movements. It is the typical case of the flexion of the toe, which obliges the bones of the toes, at the height of the metatarsus, to make an excessive upward flexion. This is a phenomenon that can cause at least the stiffening of the foot, or even cause damage of different entity, such as for example localized breaking, obliging the person to take often prolonged stops.

Recently, on the official web-site of Sidi Sport, an Italian company, a device has appeared, under novelties, its substantial purpose being to stiffen the sole of a series of motorcycling footwear, known as "vertebra race". The mentioned device, named "sole rigidity system", has the proper function of stiffening the sole, preventing the toe from flexing upwards during accidental contacts. On the other hand, when in the condition of normal riding, the hand-operated intervention that underlocks the device allows the sole to flex normally according to an arc that corresponds to the one structurally offered by the stronger or weaker rigidity of the upper.

Even more particularly, said device essentially consists of two elements. A first one is curved, and protrudes along the external side of the shoe, from its point towards the heel, with a development that engages about a third of the length of the sole. This element, which is practically a protection against contact with the ground, is fixed along the side on the outside of said sole, by means of the cooperation of two through screws that engage corresponding retaining means buried along the said sole. As regards the shape of said element of protection, one detects that the end of the body, facing towards the heel, ends with a conical shape that is then headed with a cursor. The cursor, on one side, is provided with a slide that interacts with an anchorage point of a wide protection plate that covers part of the side of the shoe and protracts diagonally from the plant, at the height of the tarsus, past the malleolus. As regards the other end of the cursor, it has a countershape that, by moving the cursor, is headed in correspondence with the conical extremity of the protection body. In this way, manually acting on the anchorage point of the slide, one can proceed to lock the slide and consequently the cursor headed on the protection body, achieving the complete stiffening of the sole.

By examining the device described above, it would seem possible to register the cursor, even in intermediate positions, or between the standstill against the protection body and the opposite end of the run. This, from a practical point of view, should allow to place the cursor at a small distance from the standstill against the protection body, allowing the possibility, for the toe of the shoe, to flex in a controlled manner. The control of the flexion of the toe is therefore determined by the distance between the countershape of the cursor and the conical end of the protection body. It follows that a greater distance between the two bodies, cursor on one side and protection body on the other, corresponds to a greater rotation angle.

The solution, although it is original, has some problems. First of all, it seems that heading the cursor against the protection body, or against the slider, is mostly inefficient. This is because, to avoid the cursor giving in backwards, the user is obliged to rather tighten the screw that corresponds to its locking. Tightening with such strength said screw, can cause the cursor to weaken, if not to break, with the consequence that at the first contact with the ground, this disengages, making the main function of stiffening the sole ineffective. Moreover there is to say that the impacts to the ground during the execution of folds are rather violent and frequent, a circumstance that, because of the stiffened sole, certainly during the race and even when the device is initially intact, causes breaking and therefore the inefficiency of any function. Furthermore, because of the friction between stiffened sole and road surface, the pilot feels this contact in a stronger manner, causing the sudden displacement of the foot and therefore of the weight of the body. This sudden movement modifies the correct balance held before engaging the curve, with evident negative effects on the set up of the motorbike.

A second and not negligible inconvenience, derives from the fact that the device is used in a condition where the flexion can be controlled, for example when walking. In this hypothesis, it is well known that according to the subject, the forces engaging the shoe change, an example is the different flexion of the metatarsus in each individual when rotating the foot. The circumstance, in this case, that induces the user to keep the cursor blocked and slightly detached from the slider, induces, during walking, the two surfaces in contact to overlap, or the overcoming of the obstacle created by the standstill of the two ends.

One of the purposes of this invention is also to solve the problems mentioned above.

BRIEF SUMMARY OF THE INVENTION

This and other aims are achieved with this innovation, according to the characteristics as in the included claims, solving the mentioned problems by means of a sporting shoe equipped with a device to control the flexion of the toe, of the type including a localized low friction protection body, particularly for a technical boot designed for practicing the sport of motorcycling, removable, attached along one side of the shoe with the use of reciprocal holding means and engaging at least part of the point and of the side, said protection body being hinged to a second element, placed at the back, fixed along the external side of the shoe or a part of it, with the cooperation of a third element overlapping the first two, which, engaging the said second, provides two opposite stops that limit the run of the protection body and of the toe part of the relative shoe, or of a part thereof with respect to the back part.

In this way, through the considerable creative contribution which effects constitute an immediate technical progress, different advantages are achieved.

Firstly, one observes an improved interaction between the toe and the back part of the shoe, which are almost hinged at the height of the metatarsus. This circumstance has the advantage of avoiding the stable locking between the two parts, so that, for example when running, contact with the ground, however violent, is amortized by the natural yielding of the toe, rotating a certain number of degrees according to an arc, just the amount allowed by the reciprocal stops on the front and back portion of the control device. Solving the problem of this uncontrolled and sudden yielding, as can happen in a rigid sole stressed in such a way, avoids the upwards ultra rotation of the shoe's toe, safeguarding, above all, the front part of the foot from the mentioned and possible traumas.

There are further advantages when simply walking. In this case, the bending of each foot will result in less violent and more elastic action, causing as a lot less fatigue. The fact then of not providing any disengagement device for the hinging, this because the rotation angle is predefined, makes the device certainly more comfortable and avoids having to ask the user for hand-operated intervention on the same device to allow, each time he needs it, as for example when getting off the motorcycle, unlocking or other adjustments.

BRIEF DESCRIPTION OF THE SEVERAL VIEWS OF THE DRAWINGS

These and other advantages will become better understood by reference to the following detailed description in connection with the accompanying drawings.

DETAILED DESCRIPTION OF THE INVENTION

Figure 1:
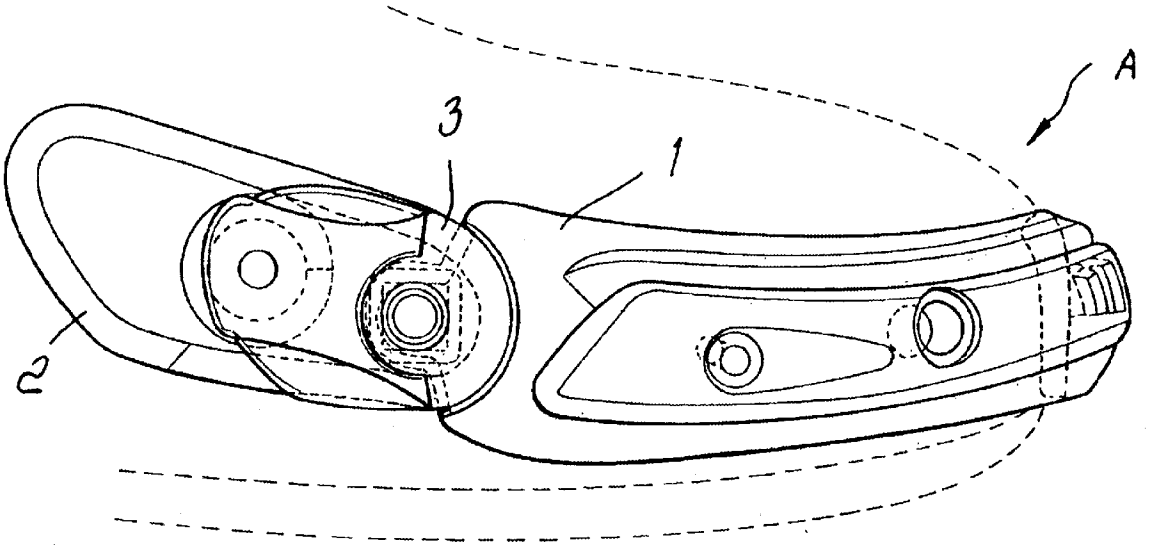
FIG. 1 is a schematic view of the control device, with the portion regarding the toe of the shoe in a completely lowered condition.
Figure 2:
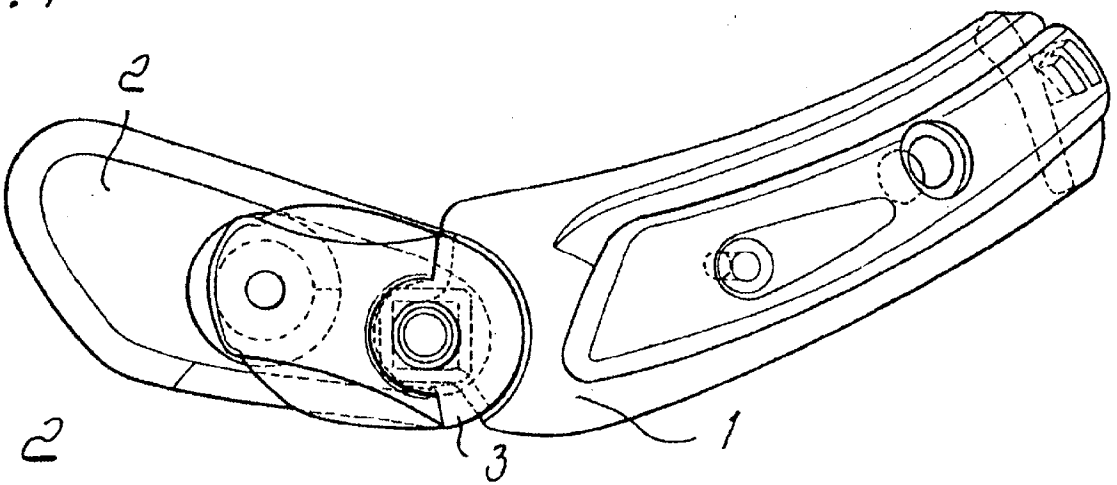
FIG. 2 is another schematic view of the control device of FIG. 1, but with the part of the shoe that corresponds to the toe in a completely raised condition.
Figure 3:
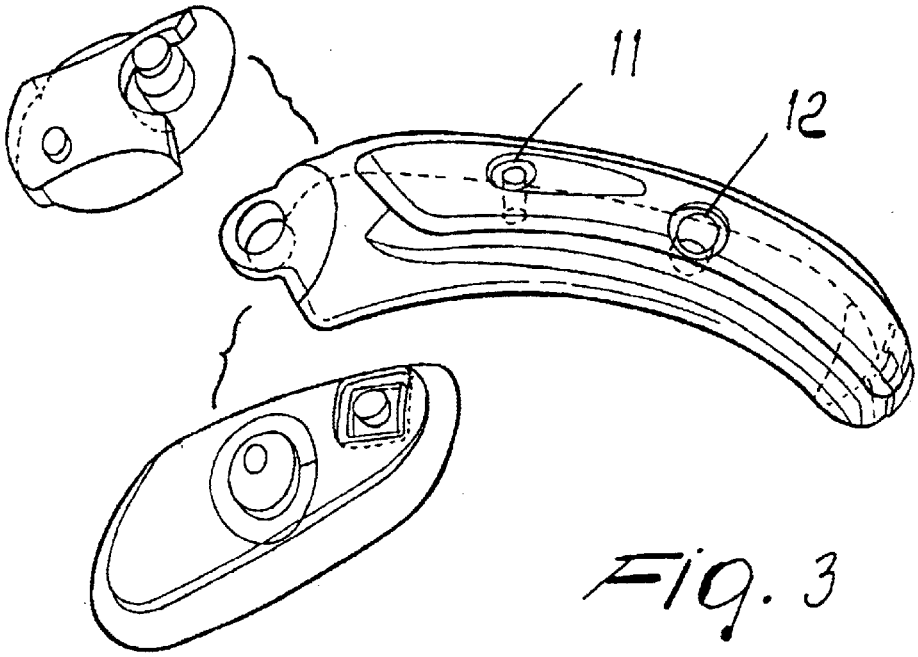
FIG. 3., is a view, taken from the internal side, of the main elements that form the control device represented in an exploded condition.
Figure 4:
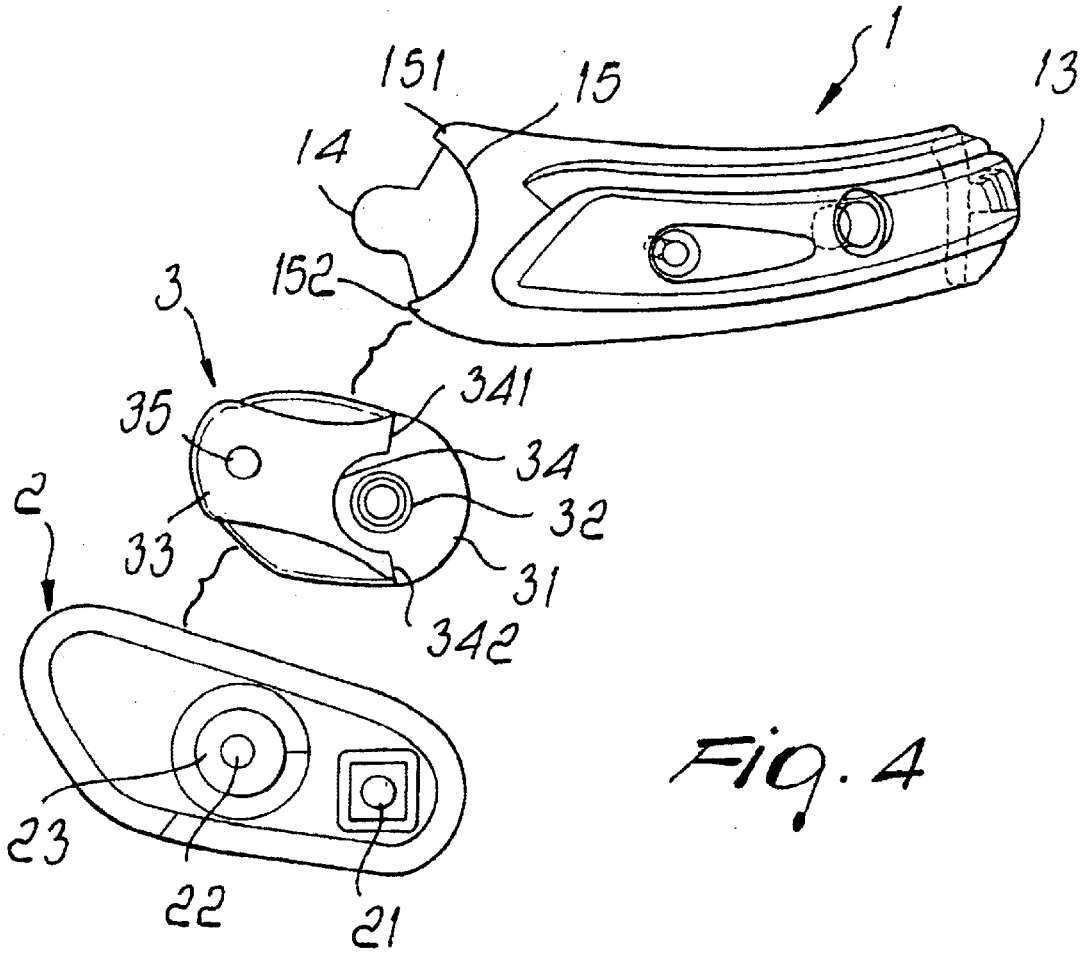
FIG. 4 is an exploded schematic view, taken from the side facing outwards, of the main elements that form the control device as in previous figures.

This regards, in detail, a flexion control device (A), which, substantially, is made up of three monolithic bodies articulated to one another, respectively, a front protection body (1) hinged to a back body (2), to which with reference to said first (1) and second body (2), a third body (3) is superimposed locally, in correspondence of the hinging, with the function of limiting and guiding the oscillation.

As regards the protection body (1), it presents an extended shape, with the extrados rounded and the intrados folded so that it can be coupled, by removable means, to a shoe in correspondence with the edge of the sole. The said body (1), which, being a protective one, also works as a slider, engages, in this case, only the outside of the shoe or of the motorcycling-boot and extends from the toe, along the side of the shoe, up to a height that can correspond to the position in one's foot of the metatarsus. In more detail, the protection body (1) can be applied to the sole through two holes, (11, 12), which, being through-holes, house the respective anchorage screws. While the front end (13) of the protection body (1) is shaped in a rounded way, the back part provides for the overhanging realization of a ring (14), with a semicircular seating (15) cooperating behind and at a small distance whose ends, realizing teeth (151) and (152), have the function of ending the stroke in the articulation of the device (A), between bodies (1) and (2).

In further detail, a pivot (21) is introduced coaxially to the ring (14), on the bottom side, its purpose being to prop the protection body (1) to the back body (2) of said device (A). Said cylindrical pivot (21), is therefore placed in correspondence with the extremity of the body (2) facing towards the front of the shoe, and emerges perpendicularly to the extrados. In this case, said back body (2) results fixed to the shoe (A) or to a part of it, by at least one through-hole (22), obtained in the central part, in correspondence of a portion whose surface is rounded (23).

Finally, to the protection body (1), that is superimposed with the end (14) to the basic body (2), is overlapped by an element (3), which interacts with the portion (14, 15) of the protection body (1). More particularly, the body (3) has a lowered extremity (31) of reduced thickness and with a rounded border which is housed, in juxtaposition, inside the seating (15) provided in the protection body (1). Always this end (31), additionally provides for a seating (32) that cooperated with with the ring (14) and the pivot (21) to obtain the hinging between the protection body (1), and the adjacent body (2). As regards the extrados of the body (3), it presents a thickening (33), which towards the protection body (1) has a semicircular shoulder (34) slightly distanced from the seating (32) that constitutes a hinging point. Said shoulder (34) has a double function. Firstly, it allows the housing of part of the ring (14) and secondarily, it realizes two opposite stops (341, 342) that cooperate with the teeth (151, 152) that constitutes oscillation stroke limiting stops of the protection body (1) in limiting the oscillation between the bodies (1, 2) to which the respective shoe portions correspond. Finally, a through-hole (35) secures the body (3) to the under-placed basic body (2) coupling the rounded surface (23) with the corresponding portion of counter-shaped intrados of the body (3).

We claim:

1. In a shoe having a flexible toe part connected to a back part thereof at a metatarsal region that corresponds to a metatarsus region of a user foot and a sole, a device for controlling flexion of the toe region comprising:

a front protection body that engages an outside region of the toe part and extends along a side of said toe part to act as a slider-protection and so that an extremity thereof arranges at the metatarsal region of the shoe, said protection body being removably coupled to the shoe;

a back body removably fixed to the outside of the shoe with an extremity thereof arranged at said metatarsal region and hinged at said extremity of said front protection body so as to provide a hinged articulation that allows oscillation strokes between said toe part and said back part; and stops provided at said hinged articulation so as to limit said oscillation strokes between said front protection body and said back body.

2. The device of claim 1, wherein said stops comprise teeth provided at said extremity of said front protection body which participate to define a rotation stroke of said front protection body with respect to said back body.

3. The device of claim 2, further comprising a third body that is locally superimposed to said front protection body and said back body, at said hinged articulation.

4. The device of claim 3, wherein said front protection body, said back body and said third body constitute three monolithic bodies articulated to one another, with said front protection body and said third body being superimposed locally so as to participate to guiding and limiting the oscillation strokes.

5. The device of claim 2, wherein said front protection body has an long, extended shape engaging only an external side of the shoe that develops at the side of the toe part and comprises a front end shaped in a rounded way and an opposite back part that corresponds to the extremity of the front protection body and which has an overhanging ring with a semicircular lowered seating placed behind the ring at a small distance, said seating having ends that form said teeth.

6. The device of claim 5, wherein said back body comprises a cylindrical pivot that emerges therefrom and is adapted to engage coaxially said ring.

7. The device of claim 6, wherein said cylindrical pivot is located at the extremity of said back body facing towards a front part of the shoe, said back body being fixed to the shoe at at least one through-hole thereof.

8. The device of claim 3, wherein said front protection body, that is joined at the extremity thereof to said back body with said third body overlapped at said hinged articulation and interacting with said teeth, said third body being comprised of a lowered extremity with a rounded border, that is housed inside an overhanging ring provided at said front protection body, and wherein said back body comprises a cylindrical pivot that emerges therefrom and is adapted to engage coaxially said overhanging ring, said lowered extremity comprising a seating that is arranged to coincide with said overhanging ring and said pivot that provides the hinged articulation between said front protection body (1) and the back body.

9. The device of claim 7, wherein said third body comprises a shoulder with ends that interact with said teeth of said front protection body to limit oscillation strokes between said front protection body and said back body.

10. The device of claim 9, wherein said shoulder is semicircular and is formed at an extremity of a thickening of said third body so as to be slightly distanced from said seating that provides a hinging point of said hinged articulation and so as to accommodate part of said overhanging ring.

11. The device of claim 4, wherein said third body comprises at least one through-hole provided at a rounded surface in a central part thereof for securing the third body to the underlying back body and for further coupling the back body to said rounded surface.

12. A shoe having a flexible toe part connected to a back part thereof at a metatarsal region that corresponds to a metatarsus region of a user foot, a sole, and a device for controlling flexion of the toe region, said device comprising:

a front protection body that engages an outside region of the toe part and extends along a side of said toe part at an edge region of said sole to act as a slider-protection and so that an extremity thereof arranges at the metatarsal region of the shoe, said protection body being removably coupled to the shoe;

a back body removably fixed to the outside of the shoe with an extremity thereof arranged at said metatarsal region and hinged at said extremity of said front protection body so as to provide a hinged articulation that allows oscillation strokes between said toe part and said back part;

a third body that is locally superimposed to said front protection body and said back body, at said hinged articulation; and stops provided at said hinged articulation so as to limit said oscillation strokes between said front protection body and said back body.

13. A shoe having a flexible toe part connected to a back part thereof at a metatarsal region that corresponds to a metatarsus region of a user foot, a sole, and a device for controlling flexion of the toe region, said device comprising:

a front protection body that engages an outside region of the toe part and extends along a side of said toe part at an edge region of said sole to act as a slider-protection and so that an extremity thereof arranges at the metatarsal region of the shoe, said protection body being removably coupled to the shoe;

a back body removably fixed to the outside of the shoe with an extremity thereof arranged at said metatarsal region and hinged at said extremity of said front protection body so as to provide a hinged articulation that allows oscillation strokes between said toe part and said back part;

a third body that is locally superimposed to said front protection body and said back body at said hinged articulation;

oscillation stroke limiting stops provided at said third body; and oscillation stroke limiting stops provided on said front protection body, at said hinged articulation for limiting in cooperation with said oscillation stroke limiting stops provided at said third body said oscillation strokes between said front protection body and said back body.

* * * * *